US010401019B2

(12) United States Patent
Xia et al.

(10) Patent No.: US 10,401,019 B2
(45) Date of Patent: Sep. 3, 2019

(54) CONTAINER WITH TOUCH SENSITIVE FUNCTION

(71) Applicant: SHENZHEN ROYOLE TECHNOLOGIES CO. LTD., Shenzhen, Guangdong (CN)

(72) Inventors: Xinyuan Xia, Guangdong (CN); Xiang Zou, Guangdong (CN); Rui Xu, Guangdong (CN); Yu Zhou, Guangdong (CN); Ji Wang, Guangdong (CN); Zhanchao Liu, Guangdong (CN); He Li, Guangdong (CN)

(73) Assignee: SHENZHEN ROYOLE TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 15/750,965

(22) PCT Filed: Dec. 31, 2015

(86) PCT No.: PCT/CN2015/100153
§ 371 (c)(1),
(2) Date: Feb. 7, 2018

(87) PCT Pub. No.: WO2017/113309
PCT Pub. Date: Jul. 6, 2017

(65) Prior Publication Data

US 2018/0238536 A1 Aug. 23, 2018

(51) Int. Cl.
*F21V 33/00* (2006.01)
*A47G 19/22* (2006.01)
(Continued)

(52) U.S. Cl.
CPC ..... *F21V 33/0036* (2013.01); *A47G 19/22* (2013.01); *A47G 19/2227* (2013.01);
(Continued)

(58) Field of Classification Search
CPC ..... F21V 33/0036; A47G 19/22; A47G 2019/2238; F21Y 2115/10
See application file for complete search history.

(56) References Cited

U.S. PATENT DOCUMENTS 5,523,131 A * 6/1996 Isaacs ..... A47G 19/2227 428/34.1
2004/0017678 A1* 1/2004 Liu ..... A47G 19/2227 362/101
(Continued)

FOREIGN PATENT DOCUMENTS

CN 2568570 Y 8/2003
CN 201602518 U 10/2010
(Continued)

OTHER PUBLICATIONS

International search report dated Sep. 21, 2016 from corresponding application No. PCT/CN2015/100153.

*Primary Examiner* — Tracie Y Green
(74) *Attorney, Agent, or Firm* — Hauptman Ham, LLP

(57) ABSTRACT

A container includes a light source and an accommodating cavity. The container further includes a control component and a touch control panel arranged at a location of the accommodating cavity which is easy gripped. The control component is electrically coupled to the light source and the touch control panel. The control component controls the light source to emit light according to an external touch signal sensed by the touch control panel. The container employs the touch control panel as a sensing switch. Upon a user touching a side face of the container with a hand, the control component turns on the light source to emit light, and when the user's fingers leave the container, the control component controls the light source to be turned off.

16 Claims, 3 Drawing Sheets

(51) Int. Cl.
*F21V 23/04* (2006.01)
*F21Y 115/10* (2016.01)

(52) U.S. Cl.
CPC .. *F21V 23/0485* (2013.01); *A47G 2019/2238* (2013.01); *F21Y 2115/10* (2016.08)

(56) References Cited

U.S. PATENT DOCUMENTS

| | | | | |
|---|---|---|---|---|
| 2004/0136177 | A1 | 7/2004 | Lewis et al. | |
| 2005/0036301 | A1 | 2/2005 | Haines | |
| 2014/0185277 | A1* | 7/2014 | Mongeli ..... | A47G 19/2227 362/157 |
| 2014/0268666 | A1 | 9/2014 | Bretschneider | |
| 2014/0300273 | A1* | 10/2014 | LeBrun ..... | G09F 23/06 315/76 |

FOREIGN PATENT DOCUMENTS

| | | | |
|---|---|---|---|
| CN | 202154115 | U | 3/2012 |
| CN | 202445731 | | 9/2012 |
| CN | 202801035 | | 3/2013 |
| CN | 202919743 | | 5/2013 |
| CN | 203074004 | U | 7/2013 |
| CN | 204908904 | | 12/2015 |

* cited by examiner

CONTAINER WITH TOUCH SENSITIVE FUNCTION

RELATED APPLICATIONS

The present application is a National Phase of International Application Number PCT/CN2015/100153, filed Dec. 31, 2015.

TECHNICAL FIELD

The present disclosure relates to the field of electronic device, and particularly to a container.

BACKGROUND

Cups, as necessities in daily life, are gradually integrated with more and more functions for facilitating people's use. For example, in order to improve the ornamental value of a cup, the cup is internally integrated with a light source, and the cup is enabled to emit light through irradiation of the light source.

The existing light-emitting cup is usually provided with a switch at the bottom of the cup, and on and off of the light source is controlled by the switch. When a user needs to light up a cup, the user firstly overturns the cup, and then presses the switch so that the light source is powered up to emit light. However, the light-up mode of the light-emitting cup is relatively complex. Moreover, since the switch is arranged at the bottom of the cup, the user needs to look for the switch after overturning the cup, and if the environment is in poor light, it becomes difficult to see the switch. To sum up, the user experience of the existing light-emitting cup is not good.

SUMMARY

The object of the present disclosure is to provide a container to improve the user experience.

In order to solve the above technical problem, the present disclosure provides a container which includes a light source and an accommodating cavity. The container further includes a control component and a touch control panel arranged at a location of the accommodating cavity which is easily gripped. The control component is electrically coupled to the light source and the touch control panel. The control component controls the light source to emit light according to an external touch signal sensed by the touch control panel.

The container of the present disclosure employs the touch control panel as a sensing switch. Upon a user touching the touch control panel on the container with a hand, the control component turns on the light source to emit light, and when user's fingers leave the container, the control component controls the light source to be turned off. Thus, the container is lighted up when the user picks up the container, and is not lighted up when the user puts down the container, and no additional operation for turning on and off the light source needs to be performed by the user, the user experience of the container thereby can be improved.

BRIEF DESCRIPTION OF THE DRAWINGS

In order to illustrate the technical solutions of the present disclosure more clearly, the accompanying drawings which need to be used in the embodiments will be briefly described. Apparently, the accompanying drawings described in the following are merely for some embodiments of the present disclosure, and a person ordinarily skilled in the art still can obtain other accompanying drawings according to these accompanying drawings without any creative effort.

DETAILED DESCRIPTION

Below technical solutions of embodiments of the present disclosure will be described clearly and completely in conjunction with the accompanying drawings of the embodiments of the present disclosure.

Figure 1:
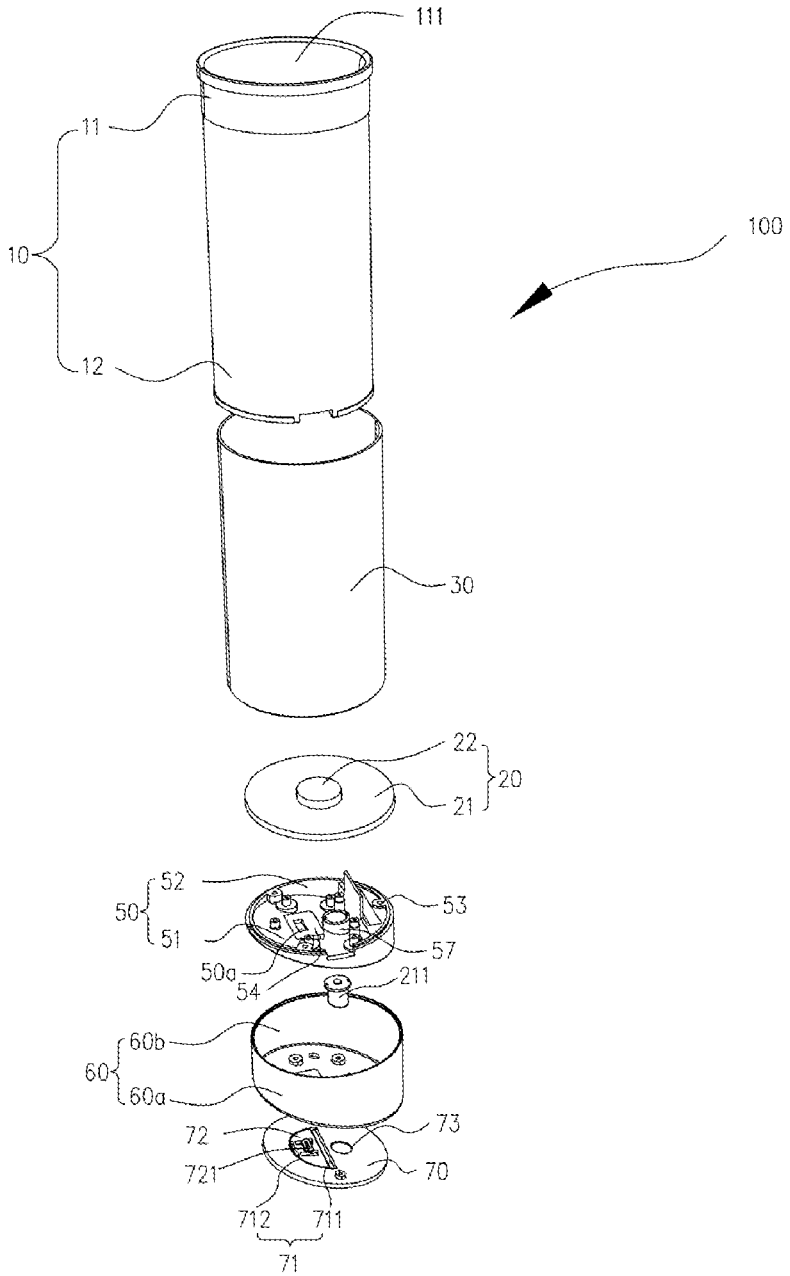
FIG. 1 is an exploded perspective view of a cup in accordance with an embodiment of the present disclosure.
Figure 2:
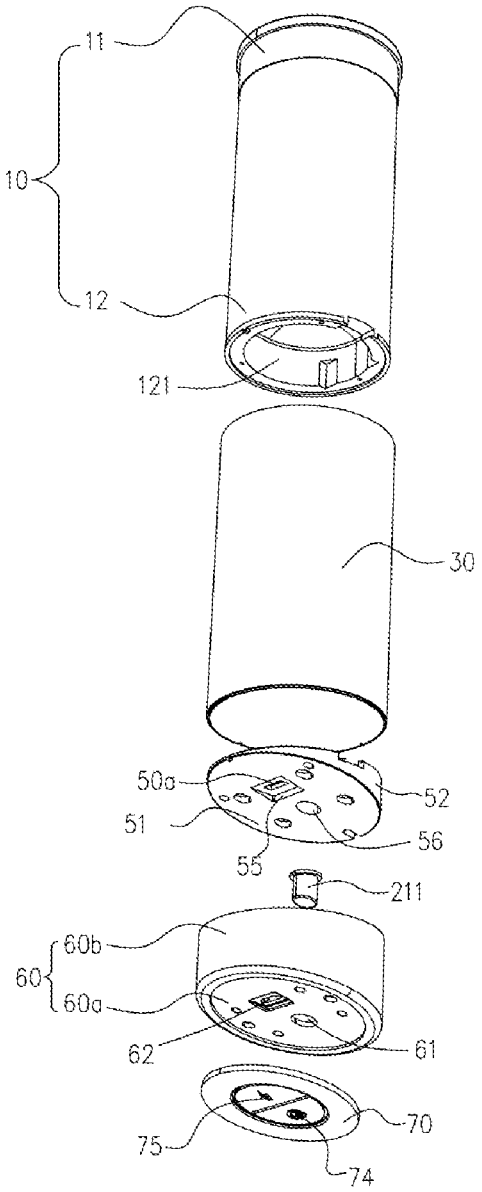
FIG. 2 is another exploded perspective view of the cup of FIG. 1, showing a light source component of the cup removed from the cup.

Referring to FIG. 1 and FIG. 2, an embodiment of the present disclosure provides a container including an accommodating cavity. In the embodiment, the container is a cup 100. In the embodiment, the accommodating cavity is a light transmitting cup body 10 which includes a top portion 11, a bottom portion 12 opposite to the top portion 11, and a middle portion located between the top portion 11 and the bottom portion 12. The top portion 11 defines a first receiving cavity 111. The opening direction of the first receiving cavity 111 is arranged reverse to the direction towards the bottom portion 12. The first receiving cavity 111 is used to receive an object. The cup 100 further includes a light source component 20 fixed to the bottom portion 12. The light source component 20 can emit light to light up the light transmitting cup body 10. The cup 100 further includes a touch control panel 30 fixed to a peripheral side of the light transmitting cup body 10 and a control component (not shown) fixed to the bottom portion 12. The control component is electrically coupled to the touch control panel 30 and the light source component 20. The control component receives a touch control signal from the touch control panel 30, and according to the touch control signal, the control component controls the light source component 20 to emit light, and controls the light emitting intensity and color of the light source component 20.

The light transmitting cup body 10 can be lighted up as the light source component 20. The touch control panel 30, upon the user's touching, sends touch control information to the control component, so as to control the light source component 20 to emit light or be turned off, and control the light emitting intensity of the light source component 20, thus better user experience of the cup 10 can be provided.

In the embodiment, the light transmitting cup body 10 is in a cylindrical shape. The light transmitting cup body 10 is integrally formed by employing a transparent acrylic adhesive. An opening of the first receiving cavity 111 is defined on an end face of the top portion 11. In other embodiments, the light transmitting cup body also may be a square column, and the light transmitting cup body 10 also may be made from other light conducting materials.

Figure 3:
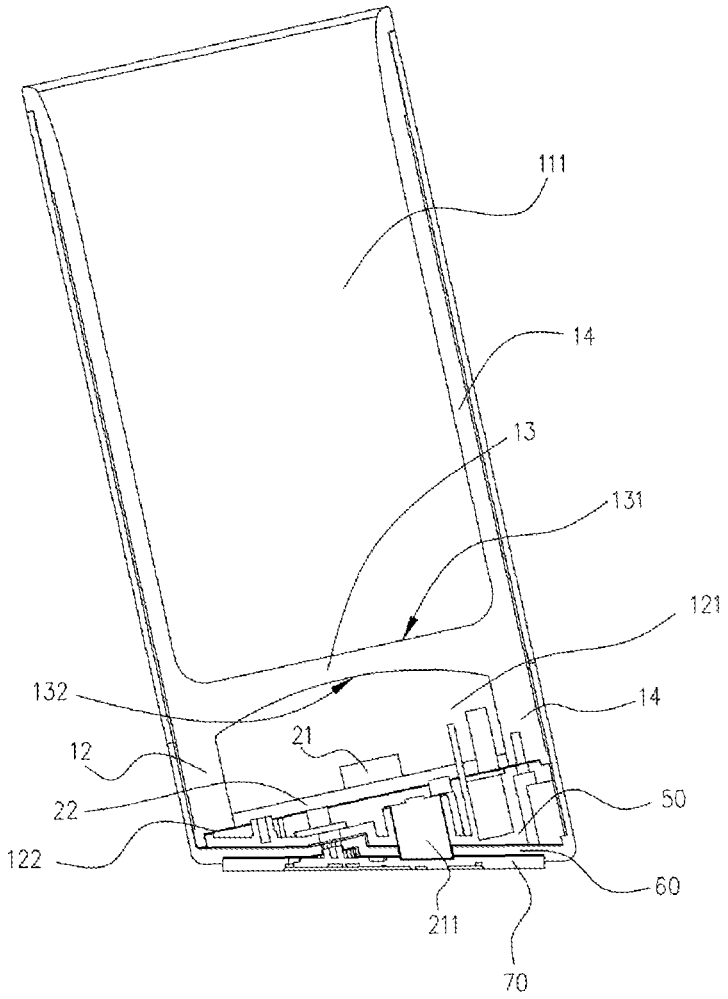
FIG. 3 is a sectional schematic view of the cup of FIG. 1 after assembled.

Referring to FIG. 3, furthermore, an extending direction of the light transmitting cup body 10 (in the embodiment, the extending direction of the light transmitting cup body 10 is its length direction) and a vertical direction define an angle therebetween. The opening direction of the first receiving cavity 111 is parallel to the extending direction of the light transmitting cup body 10. The light transmitting cup body 10 is inclined with respect to the vertical direction. The opening direction of the first receiving cavity 111 is inclined with respect to the vertical direction, thus it is convenient to add liquid to the first receiving cavity 111, and the convenience of the cup 100 is increased. The opening of the first receiving cavity 111 is circular, so as to facilitate the processing of the light transmitting cup body 10. In other embodiments, the extending direction of the cup 10 also may extend along a bent curve, and the opening of the first receiving cavity 111 also may be square.

Furthermore, the bottom portion 12 defines a second receiving cavity 121. The opening direction of the second receiving cavity 121 is arranged reverse to the opening direction of the first receiving cavity 111. The light source component 20 and the control component are both fixed in the second receiving cavity 121. A bottom face of the bottom portion 12 defines a notch.

In the embodiment, the opening of the second receiving cavity 121 is elliptical. The second receiving cavity 121 is isolated from the first receiving cavity 111 by a baffle 13, so that the second receiving cavity 121 can protect the light source component 20 and the control component. The first receiving cavity 111 has a volume bigger than that of the second receiving cavity 121. The first receiving cavity 111 has an inner diameter bigger than that of the second receiving cavity 121, so that a side wall 14 of the light transmitting cup body 10 has a varied thickness. Specifically, the thickness of the side wall 14 of the light transmitting cup body 10 at a place corresponding to the first receiving cavity 111 is smaller than the thickness at a place corresponding to the second receiving cavity 121. In other words, the baffle 13 is taken as a demarcation to divide the thickness of the side wall 14 of the light transmitting cup body 10, and the cup 100 shown in FIG. 3 is taken as a reference, where the thickness of the side wall 14 above the baffle 13 is smaller than the thickness of the side wall 14 below the baffle 13. The baffle 13 is perpendicular to the side wall 14 of the light transmitting cup body 10, a top face 131 of the baffle 13 is a plane perpendicular to the side wall 14, and a bottom face 132 of the baffle 13 is a concave face recessed towards the top face 131. The concave face of the baffle 13 can diffuse light emitted by the light source component 20 from the second receiving cavity 121 to the first receiving cavity 111, so that the light is more uniform. The light source component 20 and the control component can be fixed to an inner side wall of the second receiving cavity 121, and also can be fixed to the opening of the second receiving cavity 121 through a support panel, so as to facilitate disassembling or maintenance of the light source component 20 and the control component. In other embodiments, the light source component 20 and the control component also can be embedded to the bottom portion 12.

In the embodiment, the light source component 20 may be an LED module. The light source component 20 emits light to the light transmitting cup body 10, so that the light transmitting cup body 10 is lighted up, thus it is convenient to use the cup 100 in dark environments. The light source component 20, upon receiving a control instruction from the control component, can be in a light emitting or an off state. According to the control instruction from the control component, the light emitting intensity also can be changed, and the illumination color also can be changed according to the control instruction from the control component. In other embodiments, the light source component 20 also may be a number of LED lamp beads arranged in array.

In the embodiment, the touch control panel 30 is a transparent flexible touch control panel. The touch control panel 30 surrounds a peripheral side of the light transmitting cup body 10, and lies against an outer side wall face of the light transmitting cup body 10. The touch control panel 30 can sense the touch of the user, and sense the magnitude of a touch strength of the user. Specifically, when the user' fingers touch the touch control panel 30, the touch control panel 30 senses the touch of the user, and then sends a touch signal to the control component. The control component controls the light source component 20 to emit light according to the touch signal, so as to light up the light transmitting cup body 10. When the user's fingers leaves the touch control panel 30, the touch control panel 30 does not sense the touch of the user, so that the touch control panel 30 stops sending the touch signal to the control component, thus the control component controls the light source component 20 to be turned off. When the strength of the user touching the touch control panel 30 is increased, the control component controls the light intensity of the light source component 20 to be increased. When the strength of the user touching the touch control panel 30 is decreased, the control component controls the light intensity of the light source component 20 to be decreased. The touch control panel 30 still can further send varying touch control signals to the control component according to variation of positions touched by the user, so that the control component controls the color of the light source component 20 to be changed. In other embodiments, the touch control panel 30 senses the temperature of the user's finger, and thus changes the illumination color of the light source component 20 according to the temperature information. Certainly, the control component still can be set so that once the control signal from the touch control panel 30 is received, the control component automatically changes the color of the light source component 20 continuously, while the user does not need to change the finger's position, that is, after the user touches the touch control panel 30 with his hand, even if the finger remains immobile, the control component still can control the color of the light source component 20 to be changed continuously until the user's finger leaves the touch control panel 30. Besides, the control component further can be set so that the control component adjusts the brightness of the light source component 20 when the touch control panel 30 senses that the user's finger slides along the extending direction of the light transmitting cup body 10. For example, when the user's finger slides upwardly on the touch control panel 30, the brightness of the light source component 20 is increased, and when the user's finger slides downwardly on the touch control panel 30, the brightness of the light source component 20 is decreased. It should be indicated that sliding along the extending direction of the light transmitting cup body 10 is not limited to being completely consistent with the extending direction of the light transmitting cup body 10, while a certain angle of deviation is also acceptable, as long as the sliding action generates a displacement in the extending direction of the light transmitting cup body 10.

The control component may be a control circuit or a central processing unit arranged on a mainboard. The control component receives an electrical signal from the touch control panel 30, and sends an electrical signal instruction to the light source component, so as to control the light source component 20 to operate.

Furthermore, the cup 100 further includes an inner cover 50. The inner cover 50 is received in the second receiving cavity 121. An outer side wall face of the inner cover 50 is matched with an inner side wall face of the second receiving cavity 121. The light source component 20 and the control component are both fixed to the inner cover 50.

In the embodiment, the inner cover 50 includes an elliptical inner cover plate 51 and an inner cover edge 52 surrounding a peripheral side of the inner cover plate 51. The inner cover edge 52 and the inner cover plate 51 are integrally formed. The inner cover edge 52 is matched with an inner side of the opening of the second receiving cavity 121, namely, the inner cover edge 52 is a circular frame, so that the inner cover 50 can be conveniently positioned in the second receiving cavity 121, preventing the inner cover 50 from shaking in the second receiving cavity 121. The inner cover plate 51 and the opening of the second receiving cavity 121 define an angle therebetween, so that the inner side of the opening of the second receiving cavity 121 can be conveniently covered by the inner cover plate 51. In the embodiment, the inner cover plate 51 is horizontally arranged, and a plane where the inner cover plate 51 is located and a plane where the opening of the second receiving cavity 121 is located define an angle of 30 degrees therebetween. Certainly, this angle also may be changed according to practical requirements, but preferably in a range between 10 and 60 degrees. A side of the inner cover plate 51 facing the second receiving cavity 121 is fixed with the light source component 20 and the control component, so that when the inner cover 50 is disassembled from the second receiving cavity 121, the light source component 20 and the control component can be taken out together from the second receiving cavity 121, to facilitate maintenance of the light source component 20 and the control component. In other embodiments, if the light transmitting cup body 10 is a rectangular column, the inner cover 50 also may be a rectangular cover plate.

Furthermore, the inner side wall face of the second receiving cavity 121 is provided with a step 122. The peripheral side of the inner cover plate 51 is provided with a number of equally spaced fixing portions 53. The fixing portions 53 are fixed to the step 122 through a tool such as screw.

In the embodiment, the step 122 is arranged on the inner side of the opening of the second receiving cavity 121. The step 122 extends circumferentially along the inner side of the second receiving cavity 121. The step 122 defines a number of equally spaced screw holes (not shown) along a circumferential direction. Each fixing portion 53 is corresponding to one screw hole. The fixing portions 53 are studs. The fixing portions 53 can be detachably connected to the step 122, so as to facilitate disassembling and maintenance of the inner cover 50. In other embodiments, the fixing portions 53 also may be pins, and the step 122 also may correspondingly define pin holes.

Furthermore, the light source component 20 includes a circuit board 21 fixed on the inner cover 50 and a light source 22 fixed on the circuit board 21. The light source 22 is electrically coupled to the circuit board 21. The control component is fixed on the circuit board 21, and electrically coupled to the circuit board 21.

In the embodiment, the circuit board 21 may be an aluminum substrate assisting light emitting of LED. The light source 22 may be LED lamp beads. The circuit board 21 is a circular plate. The circuit board 21 and the inner cover plate 51 define an angle therebetween, and is parallel to the plane where the opening of the second receiving cavity 121 is located. The light source 22 may be electrically coupled to the control component via a circuit on the circuit board 21. The control component may be a control circuit or a central processing unit arranged on the circuit board 21. The circuit board 21 is screw-connected to the inner cover plate 51. Specifically, a side of the inner cover plate 51 oriented towards a bottom end of the second receiving cavity 121 is provided with a number of studs. The circuit board 21 is screw-connected to the studs. The circuit board 21 and the inner cover plate 51 defines an interval therebetween. The light source 22 is soldered to a side of the circuit board 21 facing away from the inner cover plate 51. The control component is soldered to a side of the circuit board 21 adjacent to the inner cover plate 51. In other embodiments, the circuit board 21 also may be bonded to the inner cover plate 51. An outer side face of the circuit board 21 is surrounded by the inner side wall face of the second receiving cavity 121. A top face of the inner cover edge 52 of the inner cover 50 abuts against a bottom face of the step 122 of the second receiving cavity 121.

Furthermore, the circuit board 21 is provided with a battery (not shown) and a connector (not shown) electrically coupled to the battery (not shown). The battery is electrically coupled to the touch control panel 30 and the light source 22 for supplying power to the touch control panel 30 and the light source 22. The connector is used to connect an external power supply line for charging the battery. The inner cover 50 defines a connecting port **50*a*** corresponding to the connector.

In the embodiment, the battery and the connector are both arranged on a side of the circuit board 21 adjacent to the inner cover plate 51. The connector may be a USB socket, also may be a USB plug, and also may be a universal power supply socket or a universal power supply plug. The connecting port **50*a* can allow plug-in of an external power supply so that the battery can receive external power to facilitate storing power for the cup 100, thus the experience of the cup 100 is improved. In other embodiments, the connecting port 50*a* may be defined on a side wall of the bottom portion 12**.

Furthermore, the inner cover 50 is provided with a boss 54 oriented towards the baffle 13. The boss 54 abuts against the connector, and the connecting port **50*a* is defined on the boss 54**.

In the embodiment, the boss 54 extends towards the circuit board 21 along the length direction of the light transmitting cup body 10. The boss 54 abuts against the connector to, on one hand, support the connector and improve the structural stability of the cup 100, and on the other hand, facilitate connecting an external power supply line to the connector via the connecting port **50*a*. A side of the inner cover plate 51 facing away from the boss 54 further defines a recess 55 at a place corresponding to the boss 54. A bottom end of the recess 55 extends towards a top end of the boss 54, so as to facilitate the processing of the inner cover plate 51. Moreover, the depth of the connecting port 50*a* is reduced, so as to facilitate plug-connection of the external power supply line to the connector. In other embodiments, if the circuit board 21 lies against the inner cover plate 51, the inner cover plate 51** further defines a recess receiving the connector.

Furthermore, the circuit board 21 is further provided with a button 211. The button 211 is electrically coupled to the control component for sending an on or off instruction to the control component. The inner cover 50 defines a first through hole 56 for the button 211 to pass through.

In the embodiment, the button 211 is fixed on a side of the circuit board 21 adjacent to the inner cover plate 51. The first through hole 56 is defined on the inner cover plate 51. The button 211 passes through the inner cover plate 51. When the user presses the button 211, the button 211 sends the off instruction to the control component so as to disconnect the battery and the light source component 20 and the touch control panel 30, thus the cup 100 starts an energy saving state. When the user presses the button 211 again, the button 211 sends the on instruction to the control component so as to connect the battery and the light source component 20 and the touch control panel 30, thus the cup 100 starts a smart state. In other embodiments, a number of buttons 211 may be provided.

Furthermore, a side of the inner cover 50 adjacent to the circuit board 21 is further provided with a sleeve 57 sleeved on a peripheral side of the button 211. The first through hole 56 passes through an inner side of the sleeve 57. Specifically, the sleeve 57 is arranged on a side of the inner cover plate 51 adjacent to the circuit board 21. The length direction of the sleeve 57 is parallel to that of the light transmitting cup body 10. The length direction of the sleeve 57 is a geometrical central axial direction of the sleeve 57, so that when mounting the inner cover 50, it is convenient to insert the button 211 into the sleeve 57, protect the button 211 with the sleeve 57, and guide the pressing of the button 211.

Furthermore, the cup 100 further includes an outer cover 60. The outer cover 60 covers the opening of the second receiving cavity 121. The outer cover 60 defines a second through hole 61 communicating with the first through hole 56, and defines a third through hole 62 communicating with the connecting port 50*a*. The button 211 passes through the second through hole 61.

In the embodiment, the outer cover 60 is sleeved on the bottom portion 12. The outer cover 60 includes an outer cover plate 60*a* and an outer cover edge 60*b*. The outer cover plate 60*a* abuts against a bottom face of the inner cover plate 51. The outer cover edge 60*b* surrounds a peripheral side of the bottom portion 12. An inner side wall face of the outer cover edge 60*b* lies against an outer side wall face of the bottom portion 12, so as to protect the bottom portion 12 of the light transmitting cup body 10, thus the service lifespan of the cup 100 is increased. The outer side wall face of the inner cover edge 52 also lies against the inner side wall face of the outer cover edge 60*b*. Furthermore, a top face of the outer cover edge 60*b* of the outer cover 60 lies against a bottom face of the touch control panel 30, thus the whole outer side wall face of the light transmitting cup body 10 is sealed. Moreover, the outer side wall face of the outer cover edge 60*b* is flush with the outer side wall face of the touch control panel 30, so as to realize a uniform visual effect, and prevent occurrence of cutting hand. The outer cover 60 is made of a metallic material. The outer cover edge 60*b* and the outer cover plate 60*a* are integrally formed. The second through hole 61 is used for the button 211 to pass through, so as to facilitate pressing the button 211. The third through hole 62 can be used for the external power supply line to pass through, so as to facilitate connecting the external power supply line to the connector. In other embodiments, the outer cover 60 may be made of a plastic material.

Furthermore, the cup 100 further includes a bottom cover 70. The bottom cover 70 lies against a side of the outer cover 60 facing away from the inner cover 50. The bottom cover 70 defines a fan-shaped slot 71. The fan-shaped slot 71 is arranged opposite to the third through hole 62. The slot 71 includes a first edge 711 in a straight-line shape and a second edge 712 in a semi-circle shape. The first edge 711 is rotationally connected to a barrier 72. The barrier 72 is reversible with respect to the slot 71. The barrier 72 has the same shape as that of the slot 71. The barrier 72 is used to cover or expose the slot 71. Thus, when the cup 100 does not need to be charged, it is convenient for using the barrier 72 to cover the third through hole 62, so as to realize protection to the connector. More specifically, a side of the barrier 72 is provided with a protrusion 721 adjacent to the slot 71. The protrusion 721 cooperates with the third through hole 62, that is, when the barrier 72 covers the third through hole 62, the protrusion 721 is inserted into the third through hole 62 to completely seal the third through hole 62, thus the protection to the connector is enhanced.

Furthermore, a side of the bottom cover 70 lying against the outer cover plate 60*a* is provided with a positioning portion 73. The positioning portion 73 is a recess. The positioning portion 73 cooperates with the button 211, so as to conveniently position the bottom cover 70 on the outer cover plate 60*a*, and conveniently transmit the user's pressing force to the button 211 through the bottom cover 70, thus it is convenient to press the button 211. More specifically, the bottom cover 70 is made of a flexible material, or a flexible material is merely used at a place corresponding to the button 211. A side of the bottom cover 70 facing away from the outer cover plate 60*a* is provided with a button mark 74 corresponding to the positioning portion 73, so that the user can conveniently press the button 211, thus switching between the energy saving state and the smart state of the cup 100 can be realized. A side of the barrier 72 facing away from the protrusion 721 is provided with a charging mark 75 corresponding to the protrusion 721, so that the user can conveniently turn over the barrier 72 to charge the cup 100, thus the experience of the cup 100 is improved.

For the cup of the present disclosure, the light transmitting cup body 10 is lighted up as the light source component 20 can emit light. The touch control panel 30, upon the user's touching, sends touch control information to the control component, so that the control component, according to variation of the touch control information, can control the light source component 20 to emit light or to be turned off, and control the light emitting intensity of the light source component 20.

For the cup 100 of the present disclosure, the touch control panel 30 is used as a sensing switch. The cup 100 is lighted up by the control component to emit light when the user touches the side face of the cup 100 with a hand, and the control component controls the light source 22 to be turned off after the user's fingers leave the cup 100. Thus, the cup 100 can be lighted up when the user picks up the cup 100, and can be turned off when the user puts down the cup 100, and no additional operation for turning on and off the light source 22 needs to be performed by the user, the user experience of the cup 100 thereby can be improved. Furthermore, the brightness level and color variation of the cup 100 can be adjusted by sliding of the user's finger, thus better user experience can be provided.

Besides, all of the above embodiments take the cup 100 as an example. It can be understood that other types of containers, such as tanks, pots, and bottles, also may be suitable to the present disclosure. Moreover, the touch control panel 30 is preferably bonded to a location which is easily gripped, for example, a handle of a pot, a lifting handle of a tank, and an outer side face of a bottle.

The above-mentioned are preferable embodiments of the present disclosure. It should be indicated that for a person ordinarily skilled in the art, several improvements and modifications still can be made within the principle of the present disclosure, and these improvements and modifications also should be considered as the scope of protection of the present disclosure.

What is claimed is:

1. A container comprising:

a light source;

an accommodating cavity, the accommodating cavity comprising a light emitting cup body, a length direction of the light transmitting cup body and the vertical direction defining an angle larger than 0 degree therebetween, the light emitting cup body comprising a first receiving cavity, and an opening direction of the first receiving cavity being inclined with respect to the vertical direction;

a control component; and a touch control panel arranged on the light emitting cup body;

the control component being electrically coupled to the light source and the touch control panel, and the control component controlling the light source to emit light according to an external touch signal sensed by the touch control panel;

the light transmitting cup body further comprising a second receiving cavity opposite to the opening direction of the first receiving cavity, the light source and the control component being arranged in the second receiving cavity, and the light emitted by the light source entering into the first receiving cavity from the second receiving cavity;

the container further comprising a baffle for isolating the first receiving cavity from the second receiving cavity, the baffle comprising a flat surface facing the first receiving cavity and a concave surface facing the second receiving cavity, and the concave surface recessing toward the flat surface and being operable to diffuse the light emitted by the light source to the first receiving cavity.

2. The container of claim 1, wherein the touch control panel comprises a transparent flexible touch control panel surrounding and bonded to an outer side face of the light transmitting cup body.

3. The container of claim 1, wherein the container further comprises an inner cover, the inner cover is at least partially received within the second receiving cavity, and the inner cover abuts against a bottom portion of the light transmitting cup body.

4. The container of claim 3, wherein an inner side wall face of the second receiving cavity is provided with a step, the inner cover is provided with a fixing portion oriented towards the step, and the fixing portion is fixed to the step.

5. The container of claim 1, wherein the container further comprises a circuit board received within the second receiving cavity, and the light source and the control component are both fixed to the circuit board.

6. The container of claim 5, wherein the container further comprises a battery and a connector electrically coupled to the battery, the connector is arranged at a side of the circuit board, and the light source is arranged at an opposite side of the circuit board.

7. The container of claim 3, wherein the container further comprises an outer cover, the outer cover comprises an outer cover plate abutting against a bottom portion of the inner cover and an outer cover edge extending from a peripheral side of the outer cover plate, and the outer cover edge is sleeved on the inner cover and a peripheral side of the light transmitting cup body.

8. The container of claim 7, wherein an outer side wall face of the outer cover edge is flush with an outer side wall face of the touch control panel, and a top portion of the outer cover edge abuts against a bottom portion of the touch control panel.

9. The container of claim 7, wherein the container further comprises a button passing through the outer cover and the inner cover, and the button is electrically coupled to the control component.

10. The container of claim 9, wherein the container further comprises a bottom cover, the bottom cover lies against a bottom portion of the outer cover, the bottom cover abuts against the button, and a position of the bottom cover corresponding to the button defines a flexible area.

11. The container of claim 10, wherein the bottom cover defines a slot, a position of the bottom cover corresponding to the slot is provided with a barrier, and the barrier is rotationally connected to an edge of the slot.

12. The container of claim 1, wherein the container further comprises an inner cover detachably coupled to a bottom portion of the second receiving cavity, and the light source and the control component are arranged on the inner cover and received in the second receiving cavity.

13. The container of claim 12, wherein a plane where a bottom portion of the inner cover is located and a plane where the bottom portion of the second receiving cavity is located define an angle larger than 0 degree therebetween.

14. A container comprising:

a light source;

an accommodating cavity, the accommodating cavity comprising a light emitting cup body, the light transmitting cup body being inclined with respect to the vertical direction;

a control component;

a touch control panel arranged on the light emitting cup body; and an inner cover detachably coupled to a bottom portion of the light emitting cup body, a plane where a bottom portion of the inner cover is located and a plane where the bottom portion of the light emitting cup body is located defining an angle larger than 0 degree therebetween;

the control component being electrically coupled to the light source and the touch control panel, and the control component controlling the light source to emit light according to an external touch signal sensed by the touch control panel;

the light emitting cup body comprising a first receiving cavity and a second receiving cavity isolated from the first receiving cavity, the inner cover being detachably coupled to a bottom portion of the second receiving cavity, the light source and the control component being arranged within the second receiving cavity;

the container further comprising a baffle for isolating the first receiving cavity from the second receiving cavity, the baffle comprising a flat surface facing the first receiving cavity and a concave surface facing the second receiving cavity, and the concave surface recessing toward the flat surface and being operable to diffuse the light emitted by the light source to the first receiving cavity.

15. The container of claim 14, wherein the plane where the bottom portion of the inner cover is located and a plane where the bottom portion of the second receiving cavity is located define an angle larger than 0 degree therebetween.

16. A container comprising:

a light source;

an accommodating cavity, the accommodating cavity comprising a light emitting cup body, the light transmitting cup body being inclined with respect to the vertical direction;

a control component;

a touch control panel arranged on the accommodating cavity;

an inner cover detachably coupled to a bottom portion of the light emitting cup body, the light source and the control component being arranged on the inner cover and received in the bottom portion of the light emitting cup body; and an outer cover sleeved on both a peripheral side of the inner cover and a peripheral side of the light emitting cup body;

the control component being electrically coupled to the light source and the touch control panel, and the control component controlling the light source to emit light according to an external touch signal sensed by the touch control panel;

the light emitting cup body comprising a first receiving cavity and a second receiving cavity isolated from the first receiving cavity, the inner cover being detachably coupled to a bottom portion of the second receiving cavity, and the light source and the control component being arranged within the second receiving cavity;

the container further comprising a baffle for isolating the first receiving cavity from the second receiving cavity, the baffle comprising a flat surface facing the first receiving cavity and a concave surface facing the second receiving cavity, and the concave surface recessing toward the flat surface and being operable to diffuse the light emitted by the light source to the first receiving cavity.

* * * * *